US005542819A

United States Patent [19]

Bucher et al.

[11] Patent Number: 5,542,819

[45] Date of Patent: Aug. 6, 1996

[54] CEILING FAN SAFETY TETHER

[75] Inventors: John C. Bucher, Coral Springs; Shih Tza Wu, Lighthouse Point, both of Fla.

[73] Assignee: Chien Luen Industries Company, Ltd., Inc., Ft. Lauderdale, Fla.

[21] Appl. No.: 388,610

[22] Filed: Feb. 14, 1995

[51] Int. Cl.[6] ..... F04D 29/34

[52] U.S. Cl. ..... 416/146 R; 416/2; 416/194; 416/210 R

[58] Field of Search ..... 416/2, 5, 134 R, 416/146 R, 194, 210 R

[56] References Cited

U.S. PATENT DOCUMENTS

| | | | |
|---|---|---|---|
| 1,293,381 | 2/1919 | Dupuy | 416/2 |
| 5,405,102 | 4/1995 | Greene | 416/2 |

FOREIGN PATENT DOCUMENTS

| | | | |
|---|---|---|---|
| 2024837 | 3/1992 | Canada | 416/244 R |
| 59-155576 | 9/1984 | Japan | 416/2 |
| 62-243990 | 10/1987 | Japan | 416/244 R |
| 5-157092 | 6/1993 | Japan | 416/244 R |
| 6-88596 | 3/1994 | Japan | 416/244 R |

*Primary Examiner*—James Larson
*Attorney, Agent, or Firm*—Dominik & Stein

[57] ABSTRACT

A ceiling fan safety tether to be used with a conventional ceiling fan. The ceiling fan safety tether retains a fan blade in close proximity to the fan motor thereby preventing the fan blade from becoming a flying projectile should a break in a fan blade bracket ever occur. The ceiling fan safety tether comprises a body portion having a first and second securement coupled thereto. The first securement is secured to the fan motor housing and the second securement is secured to the fan blade. The ceiling fan safety tether is designed to be interposed between the fan blade bracket and the fan motor housing at a first end and interposed at a second end between the fan blade and the fan blade bracket. Additionally, the ceiling fan safety tether serves to provide a dampening effect that prevents noise and vibrations created in the fan motor housing from being transmitted to the fan blade.

10 Claims, 7 Drawing Sheets

CEILING FAN SAFETY TETHER

BACKGROUND OF THE INVENTION

1. The Field of the Invention

The present invention generally relates to a safety tether utilized with a conventional ceiling fan to prevent injury from a fan blade should a break in its fan blade bracket occur. More particularly, the present invention relates to a ceiling fan safety tether that serves to retain a fan blade in close proximity to the fan motor and thereby prevent the fan blade from becoming a flying projectile upon the unlikely event of a break in the fan blade bracket.

2. Description of the Prior Art

Many types of ceiling fans have been employed having various safety designs associated with them. The conventional ceiling fan consists of a motor suspended from a ceiling having a plurality of radially extending fan blades connected to the rotating motor to thereby produce the circulation of air in an enclosure. The various prior art ceiling fan designs do not provide for the protection of possible loose fan blades or in some cases, broken fan blades from becoming a flying projectile and thereby endangering people located nearby. At the present time in the industry, even though there has been few occurrences, there have been no designs of ceiling fans to alleviate this potential hazard.

In a related field of fan designs, other than ceiling fans in particular, there has been an attempt to prevent any contact with rotating fan blades through the use of a simple cage-like structure being attached to the fan assembly. Such cage-like structures have been applied generally to smaller portable fans. Some typical examples of the prior art relating to cage-like safety guards for oscillating or portable fans are: U.S. Pat. Nos. 3,261,544; 4,022,548; 4,657,712; and 4,818,183. These typical cage-like safety guards for portable fans are too cumbersome for use in ceiling fan designs due to the ceiling fans being much larger in size. Thus, these cage-like guards have not been applied to the ceiling fan art.

Therefore, there is still a need in the ceiling fan art for a form of safety means to protect people located in the area of such ceiling fans from possibly becoming injured upon the remote happening of a ceiling fan blade becoming separated from the ceiling fan assembly due to an unlikely break in a fan blade bracket or upon a fan blade possibly working loose over time from a fan blade bracket.

One form of safety guard associated with the ceiling fan art is illustrated in U.S. Pat. No. 4,064,427. This particular prior art ceiling fan guard dealt with the prevention of contact with the fan blade tips as they rotate to circulate air. The safety guard structure of U.S. Pat. No. 4,064,427 was basically in the form of an annular ring suspended from the motor housing that completely surrounded the circumference of the fan blade path. This annular ring structure does not act to prevent any flying projectiles from being released from the ceiling fan assembly, particularly in the case of a fan blade bracket breaking or a fan blade working loose from a fan blade bracket over time.

Therefore, there are inadequacies in the current ceiling fan art aimed at preventing the potential problems that could arise upon the unlikely event of a fan blade breaking or loosening from the rotating fan housing. In the remote possibillity of a fan blade breaking away from a fan blade bracket or becoming loose therefrom, the fan blade would in effect become a flying projectile and would thereby endanger the people situated nearby.

Accordingly, it is an object of the present invention to provide an improvement which overcomes the aforementioned inadequacies of the prior art and provides an improvement which is a significant contribution to the advancement of the ceiling fan art.

Another object of the present invention is to provide a ceiling fan safety tether for retaining the fan blade upon the unlikely event of the fan blade bracket breaking or the fan blade becoming loose from the fan blade bracket whereby the any possible danger of the fan blade becoming a flying projectile will be eliminated and people in the general area will not be in danger of being injured.

Another object of the present invention is to provide a ceiling fan safety tether which utilizes a minimal number of components and is therefore economical to manufacture.

Another object of the present invention is to provide a ceiling fan safety tether having a design which can be readily utilized in the present ceiling fan designs in the industry.

Another object of the present invention is to provide a ceiling fan safety tether which also provides a damping effect when positioned between the fan blade and fan blade bracket, and between the fan motor housing and the fan blade bracket. The damping effect acts to decrease vibrations and noise being created in the fan motor housing and transmitted to the fan blades.

Another object of the present invention is to provide a ceiling fan safety tether for use in a ceiling fan assembly, the ceiling fan assembly having a fan motor housing, a fan blade bracket coupled to the fan motor housing, and a fan blade coupled to the fan blade bracket, wherein the ceiling fan safety tether comprises in combination: a body portion having a first end and a second end, the body portion being of a flexible material and elongated in shape; a first anchoring means for anchoring the first end of the body portion to the fan motor housing, the first anchoring means being coupled to the first end of the body portion; and a second anchoring means for anchoring the second end of the body portion to the fan blade, the second anchoring means being coupled to the second end of the body portion, whereby the ceiling fan safety tether acts so as to retain the fan blade in close proximity to the fan motor housing, in the remote happening of the fan blade bracket breaking, thereby preventing the fan blade from becoming a flying projectile.

The foregoing has outlined some of the pertinent objects of the invention. These objects should be construed to be merely illustrative of some of the more prominent features and applications of the intended invention. Many other beneficial results can be obtained by applying the disclosed invention in a different manner or by modifying the invention within the scope of the disclosure. Accordingly, other objects and a more comprehensive understanding of the invention may be obtained by referring to the summary of the invention, and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purposes of summarizing the invention, this invention comprises a ceiling fan safety tether adapted to be applied directly to the present ceiling fan designs in the industry. The ceiling fan safety tether serves to retain the fan blades in close proximity to the ceiling fan motor in the unlikely event of a break in a fax blade bracket or upon the remote happening of a fan blade working loose from a fan blade bracket.

More particularly, the safety tether of the present invention comprises a flexible longitudinal body portion having a first and second anchoring means located at a first and second end thereof. The first anchoring means being coupled to the fan motor housing and the second anchoring means being coupled to the fan blade so as to retain the fan blade should a break in the fan blade bracket occur. The body portion being formed from a flexible and strong material capable of supporting the weight of a fan blade. The ceiling fan safety tether is of a universal design which can be readily utilized in the current ceiling fan designs in the industry.

In particular, the present invention consists of a body portion elongated in shape having a first securing eyelet located at a first end and a second securing eyelet located at a second end thereof. The first securing eyelet is secured to the fan motor housing via a screw, or the like, and the second securing eyelet is secured to the fan blade via a screw, or the like, such that the ceiling fan safety tether forms a secondary connection of the fan blade to the fan motor housing in addition to the fan blade bracket doing the same.

An important feature of the present invention is that the ceiling fan safety tether serves to guard against a fan blade becoming a flying projectile in the unllikelly event of a break occurring in a fan blade bracket or upon the remote happening of a fan blade working loose from a fan blade bracket.

Another important feature of the present invention is that the body portion of the ceiling fan safety tether is slender, flexible, and easily concealed within the fan blade bracket, thereby not detracting from the aesthetic looks of the particular ceiling fan design to which the ceiling fan safety tether is being applied.

An additional important feature of the present invention is that the ceiling fan safety tether provides a dampening effect thereby decreasing the vibrations and noise transmitted to the fan blades from the fan motor housing.

Therefore, it can be readily appreciated that the particular configuration of the ceiling fan safety tether functions to remove inadequacies present in the prior art and thereby provide a safer and improved ceiling fan. Importantly, the size and simplicity of the ceiling fan safety tether design serves to provide a fast, simple, and economical means for alleviating a current danger potential in the ceiling fan industry.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT OF THE INVENTION

Figure 1:
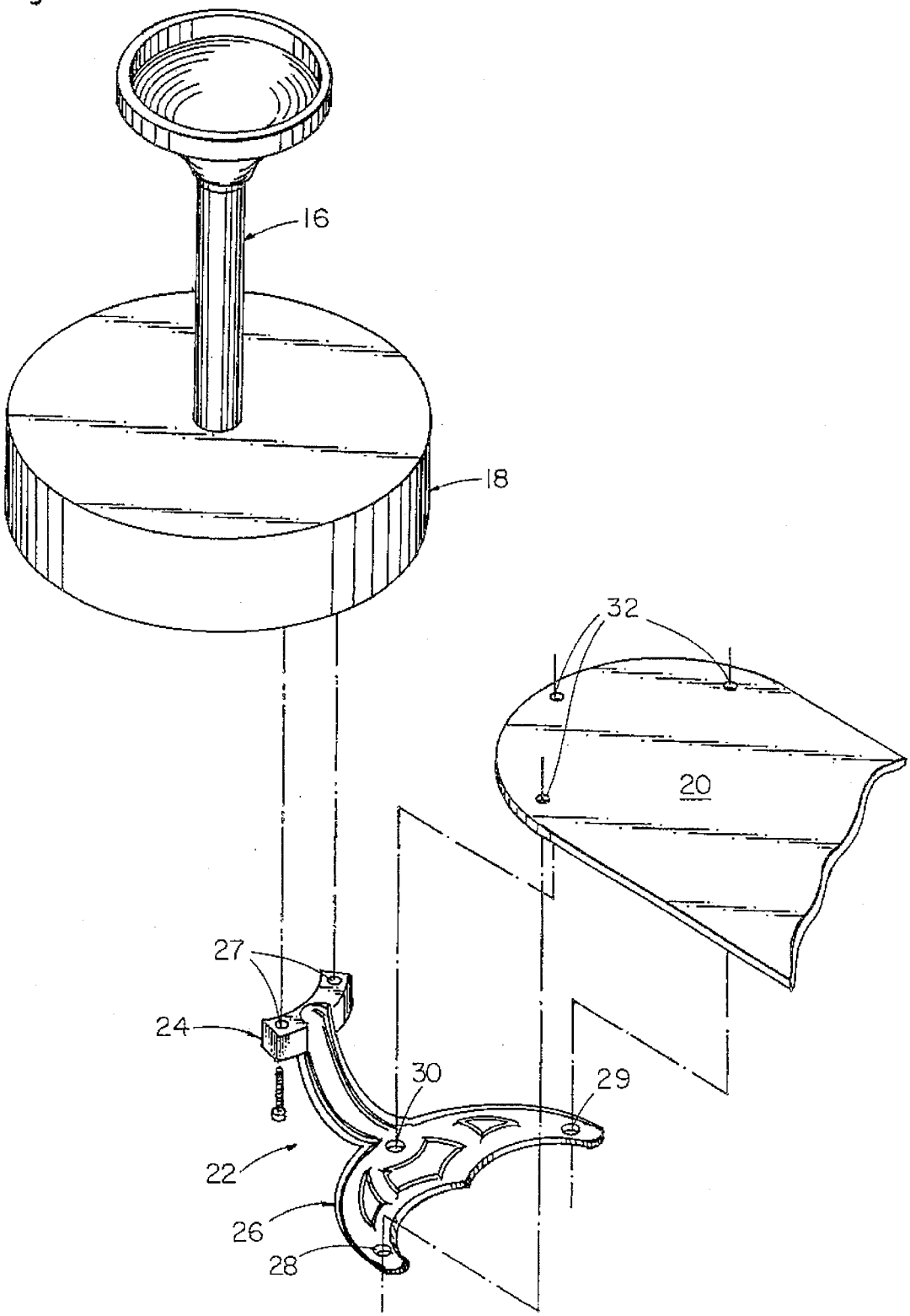
FIG. 1 is an isometric view of a conventional ceiling fan assembly having a vertical support tube, a fan motor housing, a fan blade bracket, and a fan blade as utilized in the prior art.

Referring now specifically to the drawings, the ceiling fan safety tether of the present invention is generally designated by reference numeral 10 and, as shown in FIGS. 2–8, the ceiling fan safety tether 10 is associated with a conventional ceiling fan assembly 12 which is supported in suspended relation below a ceiling 14 in a well-known and conventional manner. In referring to FIG. 1, the conventional prior art ceiling fan assembly 12 is illustrated. The ceiling fan assembly 12 includes a vertical support tube 16, a fan motor housing 18, a fan blade 20, and a fan blade bracket 22 having a mounting portion 24, and a blade support portion 26. The ceiling fan assembly 12 is of a conventional nature and of that which is used commonly in the industry.

The mounting portion 24 of the fan blade bracket 22 has a pair of mounting holes 27 therethrough so as to facilitate the insertion of screws or the like therein to secure the fan blade bracket 22 to the fan motor housing 18. The blade support portion 26 of the fan blade bracket 22 includes a first screw hole 28, a second screw hole 29, and a middle screw hole 30, each of which is for receiving a respective screw to facilitate securing the fan blade 20 to the fan blade bracket 22. The first, second, and middle screw holes, 28, 29 and 30 respectively, are positioned so as to form an arcuate pattern on the blade support portion 26.

The fan blade 20 has a plurality of securing holes 32 which are in alignment with and form the same arcuate pattern as the first, second, and middle screw holes, 28, 29 and 30 respectively, in the blade support portion 26. A conventional screw, bolt, or the like, is inserted through the screw holes, 28, 29 and 30 of the blade support portion 26 and the securing holes 32 of the fan blade 20 so as to secure the fan blade 20 to the fan blade bracket 22.

Figure 2:
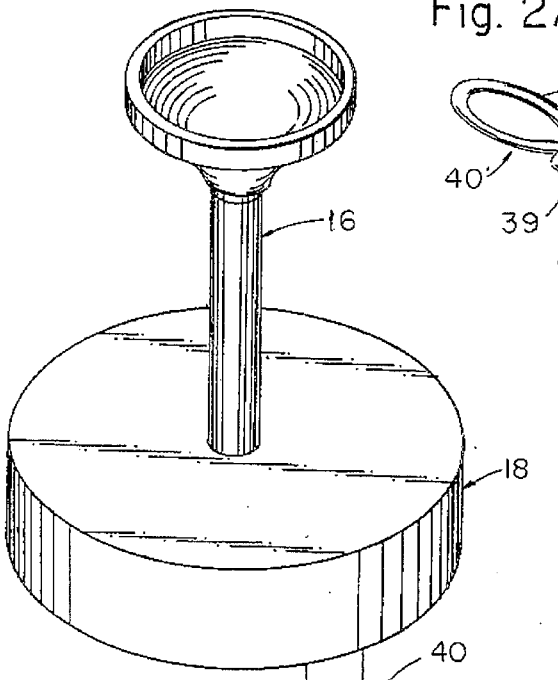
FIG. 2 is an isometric assembly view showing the ceiling fan safety tether in relative position to the fan blade, the fan blade bracket, and the fan motor housing.
Figure 2A:
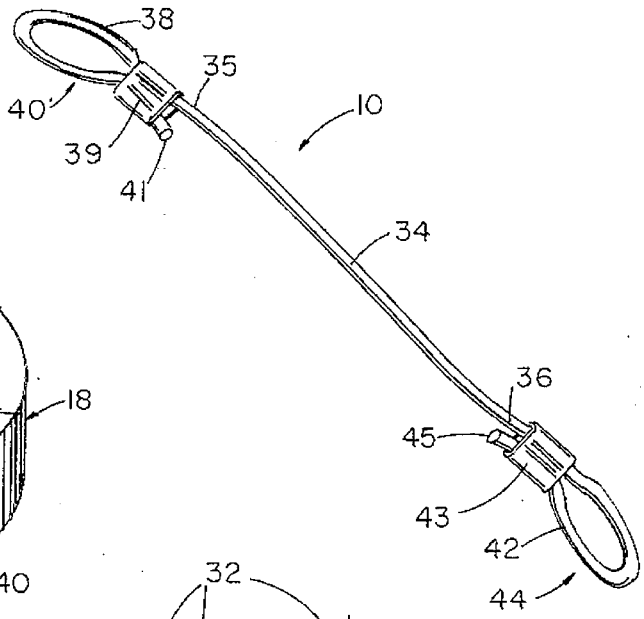
FIG. 2*a* is a front plan view showing the ceiling fan safety tether in greater detail.
Figure 2A:
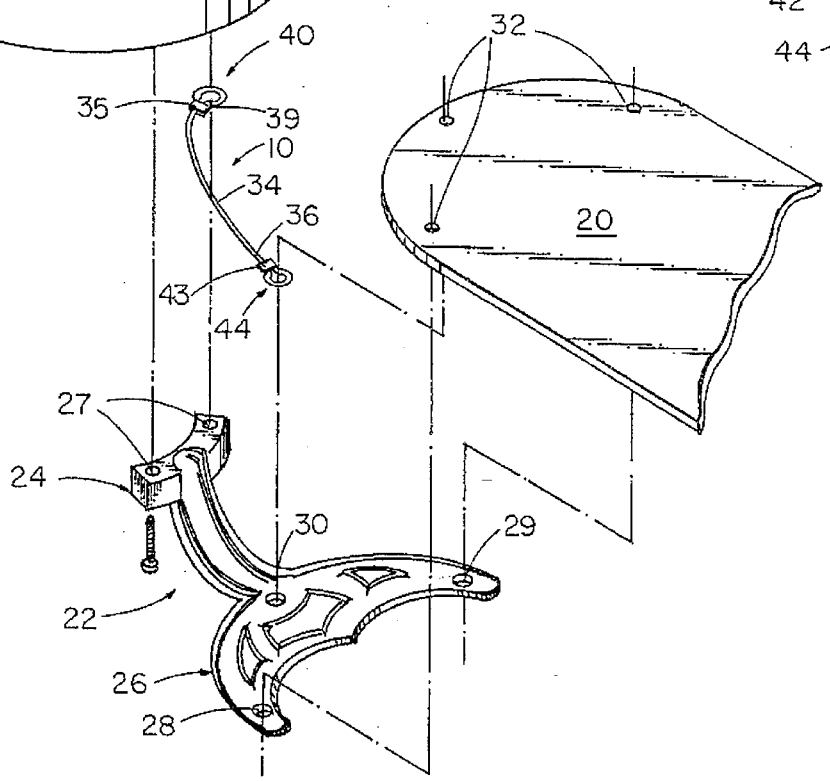

In referring to FIGS. 2 and 2*a*, the ceiling fan safety tether 10 is illustrated in detail and is shown in its relative position as applied to the prior art ceiling fan assembly 12. The ceiling fan safety tether 10 includes a body portion 34 having a first end 35 and a second end 36. The body portion 34 is of a flexible material and elongated in shape. A metallic braided cable of the type commonly available in the industry is typical of the material used for the body portion 34.

A flexible first extension portion 38 and a first crimp collar 39 form a first securing eyelet 40. The first extension portion 38 extends integrally from the first end 35 of the body portion 34 and is bent in the shape of a circle. The first extension portion 38 includes a first crimping end 41 of which is forcibly secured by the first crimp collar 39 to the first end 35 of the body portion 34. The first securing eyelet 40 is thereby being defined by the fixedly closed circular shape of the first extension portion 38. The first securing eyelet 40 thereby defines a first anchoring means.

A flexible second extension portion 42 and a second crimp collar 43 form a second securing eyelet 44. The second extension portion 42 extends integrally from the second end 36 of the body portion 34 and is bent in the shape of a circle. The second extension portion 42 includes a second crimping end 45 of which is forcibly secured by the second crimp collar 43 to the second end 36 of the body portion 34. The second securing eyelet 44 is thereby defined by the fixedly closed circular shape of the second extension portion 42. The second securing eyelet 44 thereby defines a second anchoring means.

To incorporate the ceiling fan safety tether 10 into the ceiling fan assembly 12, the first securing eyelet 40 is positioned between the mounting portion 24 of the fan blade bracket 22 and the fan motor housing 18. The first securing eyelet 40 is placed in alignment with one of the mounting holes 27 of the mounting portion 24. Screws or the like are inserted through the mounting holes 27 of the mounting portion 24 to threadingly engage the fan motor housing 18. One of the screws thereby passing through the first securing eyelet 40 and resultingly securing the first end 35 of the body portion 34 to the fan motor housing 18.

The second securing eyelet 44 is then positioned between the blade support portion 26 of the fan blade bracket 22 and the fan blade 20. The second securing eyelet 44 is placed in alignment with the middle screw hole 30 of the blade support portion 26 and one of the corresponding securing holes 32 of the fan blade 20. A screw, or the like, is then inserted through the middle screw hole 30 of the blade support portion 26 and the second securing eyelet 44 aligned therewith to threadingly engage one of the corresponding securing holes 32 in the fan blade 20 thereby securing the second end 36 of the body portion 34. Upon being secured in place, the ceiling fan safety tether 10 prevents the fan blade 20 from becoming a flying projectile in the unlikely event of a break in the fan blade bracket 22.

Figure 3:
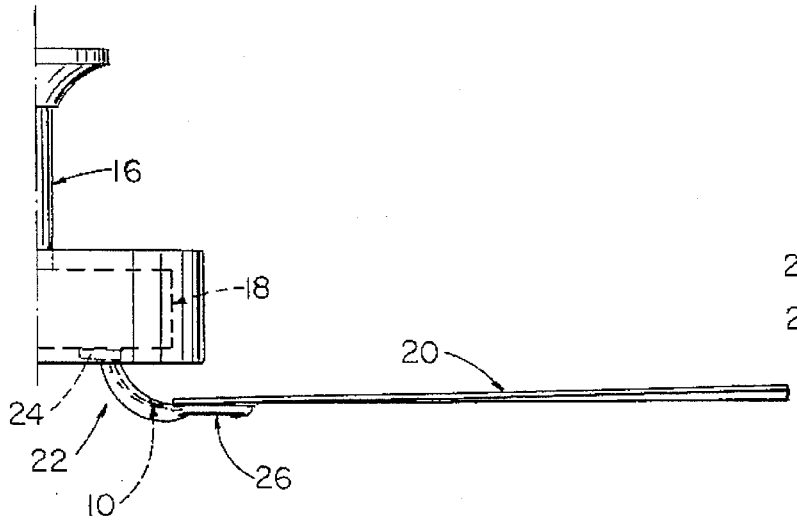
FIG. 3 is a partial front plan view of the ceiling fan illustrating the fan blade bracket rigidly connected to the fan blade which extends radially outward therefrom and the ceiling fan safety tether in position within the fan blade bracket.
Figure 4:
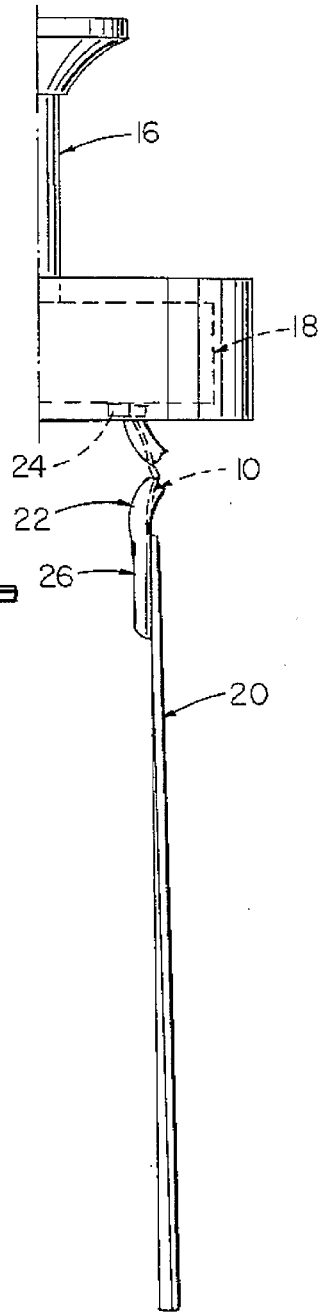
FIG. 4 is a partial front plan view illustrating the ceiling fan safety tether retaining the fan blade upon a break in the fan blade bracket.

In referring to FIG. 3, the ceiling fan safety tether 10 can be seen in position as installed in a ceiling fan assembly 12. The body portion 34 is shown to be concealed within the fan blade bracket 22 thereby not detracting from any ornamental aspects of the ceiling fan assembly 12. FIG. 4 illustrates the ceiling fan safety tether 10 in operation serving to retain the fan blade 20 in close proximity to the fan motor housing 18 in the unlikely event of a break occurring in the fan blade bracket 22.

Figure 5:
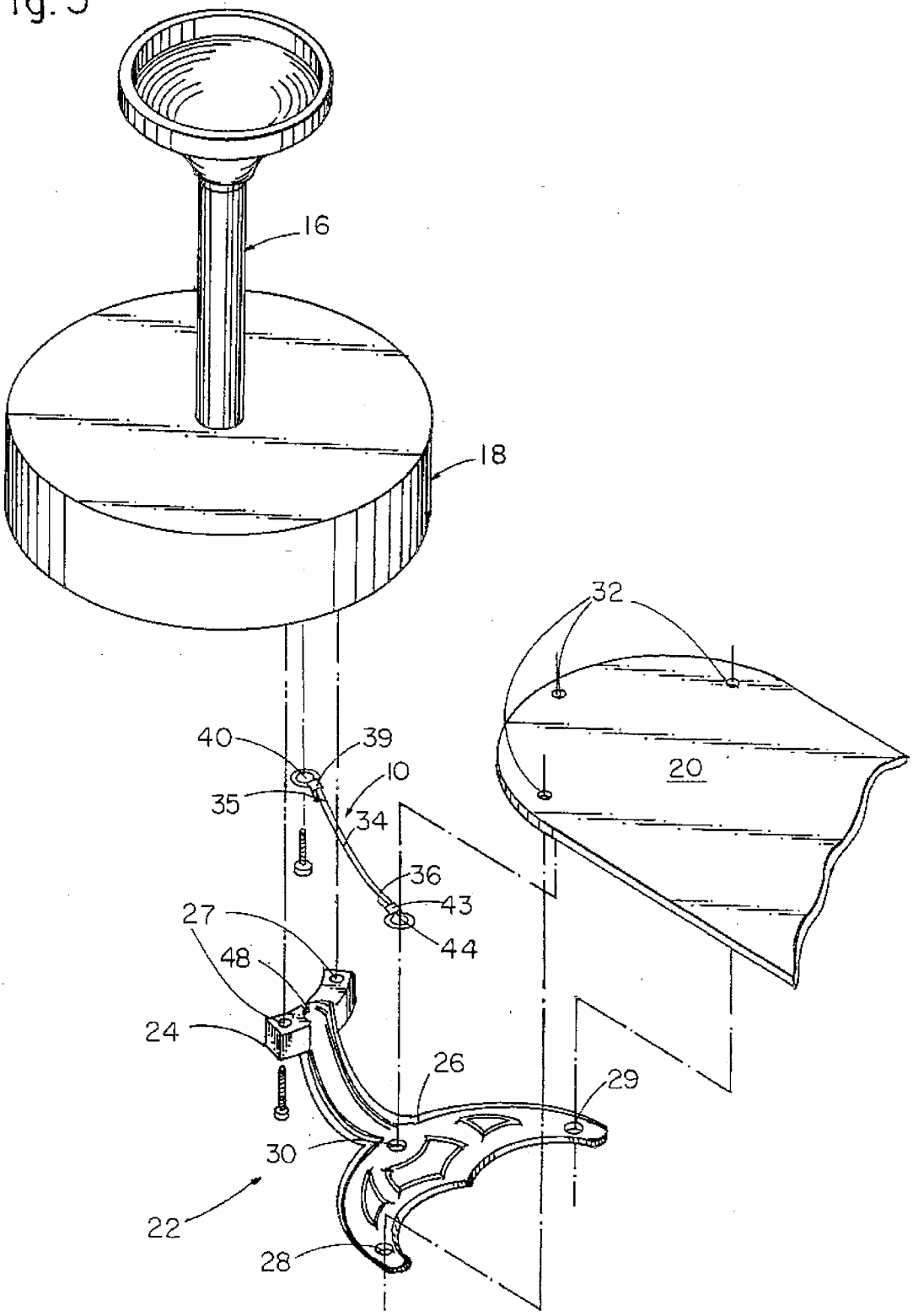
FIG. 5 is an isometric assembly view illustrating an alternate method of securing the first anchoring means of the ceiling fan safety tether to the fan motor housing using an additional screw.

In now referring to FIG. 5, an alternate method for fixing the first securing eyelet 40 of the ceiling fan safety tether 10 to the fan motor housing 18 is illustrated. A groove 48 is first placed in the mounting portion 24 of the fan blade bracket 22 intermediate to the pair of mounting holes 27. The first end 35 of the body portion 34 is placed in the groove 48 with the first securing eyelet 40, integral with the first end 35 of the body portion 34, extending therefrom. A screw or the like is inserted through the first securing eyelet 40 and threadedly received by the fan motor housing 18. The first end 35 of the body portion 34 thereby being secured to the fan motor housing 18. The second securing eyelet 44 is secured to the fan blade 20 in the same manner as described previously and illustrated in FIGS. 2, 5, and 6.

Figure 6:
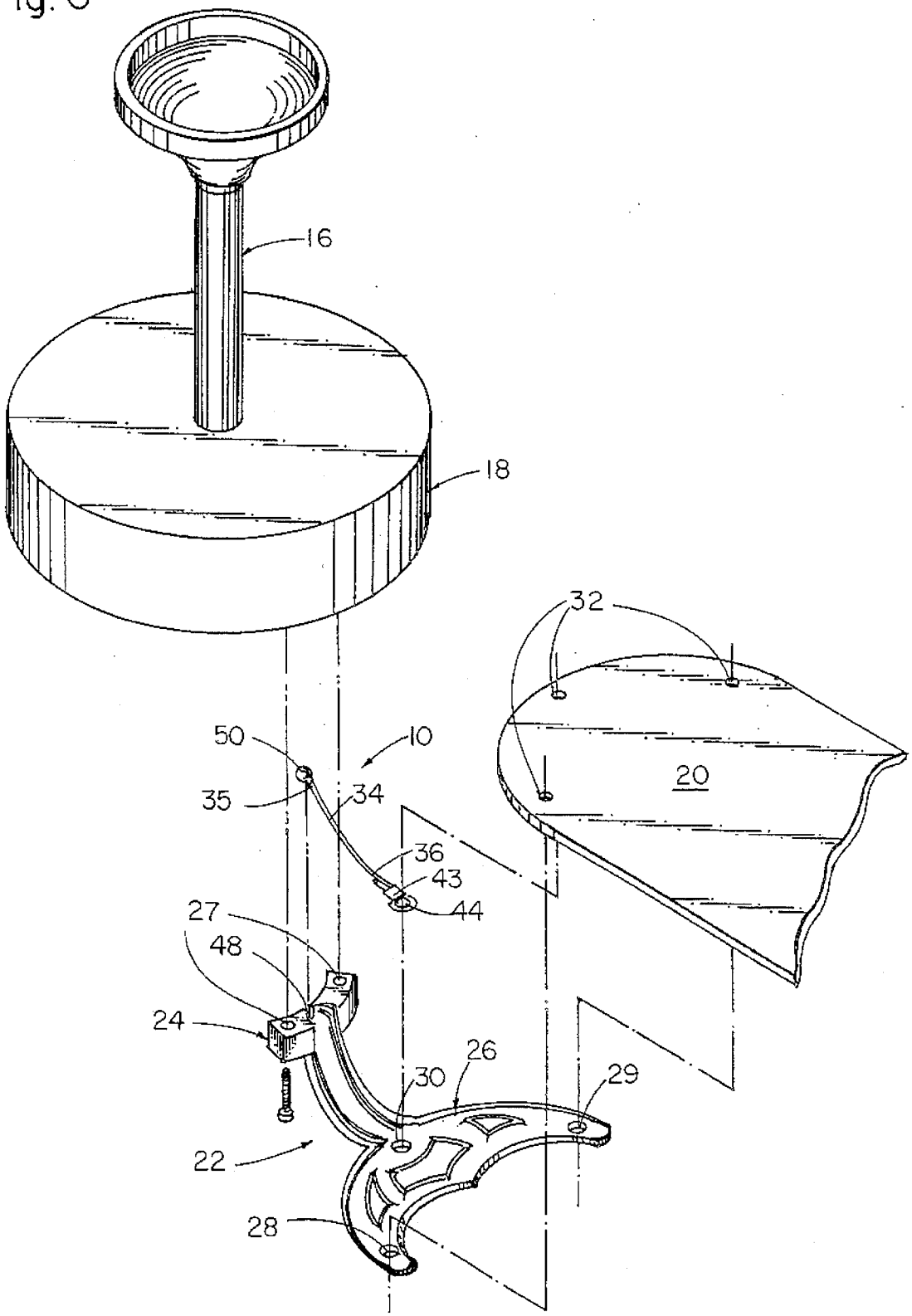
FIG. 6 is an isometric assembly view illustrating an alternate embodiment of the ceiling fan safety tether having an alternate bead-and-groove first anchoring means, the alternate embodiment of the ceiling fan safety tether being shown in its relative position to the fan blade bracket, the fan blade, and the fan motor housing.

In referring to FIG. 6, a second embodiment of the ceiling fan safety tether 10 is illustrated having a bead-and-groove first anchoring means. In this embodiment, the first end 35 of the body portion 34 has a spherical bead 50 coupled thereto. The fan blade bracket 22, as described in the previous alternate method for fixing the first securing eyelet 40 to the fan motor housing 18 and shown in FIG. 5, includes the mounting portion 24 having the groove 48 therein which is utilized to engage the spherical bead 50. The groove 48 is smaller in dimension than the spherical bead 50 so as to prevent the spherical bead 50 from passing through. The groove 48 receives the first end 35 of the body portion 34 and concurrently engages the spherical bead 50 coupled to the first end 35 when the mounting portion 24 is secured to the fan motor housing 18.

Figure 7:
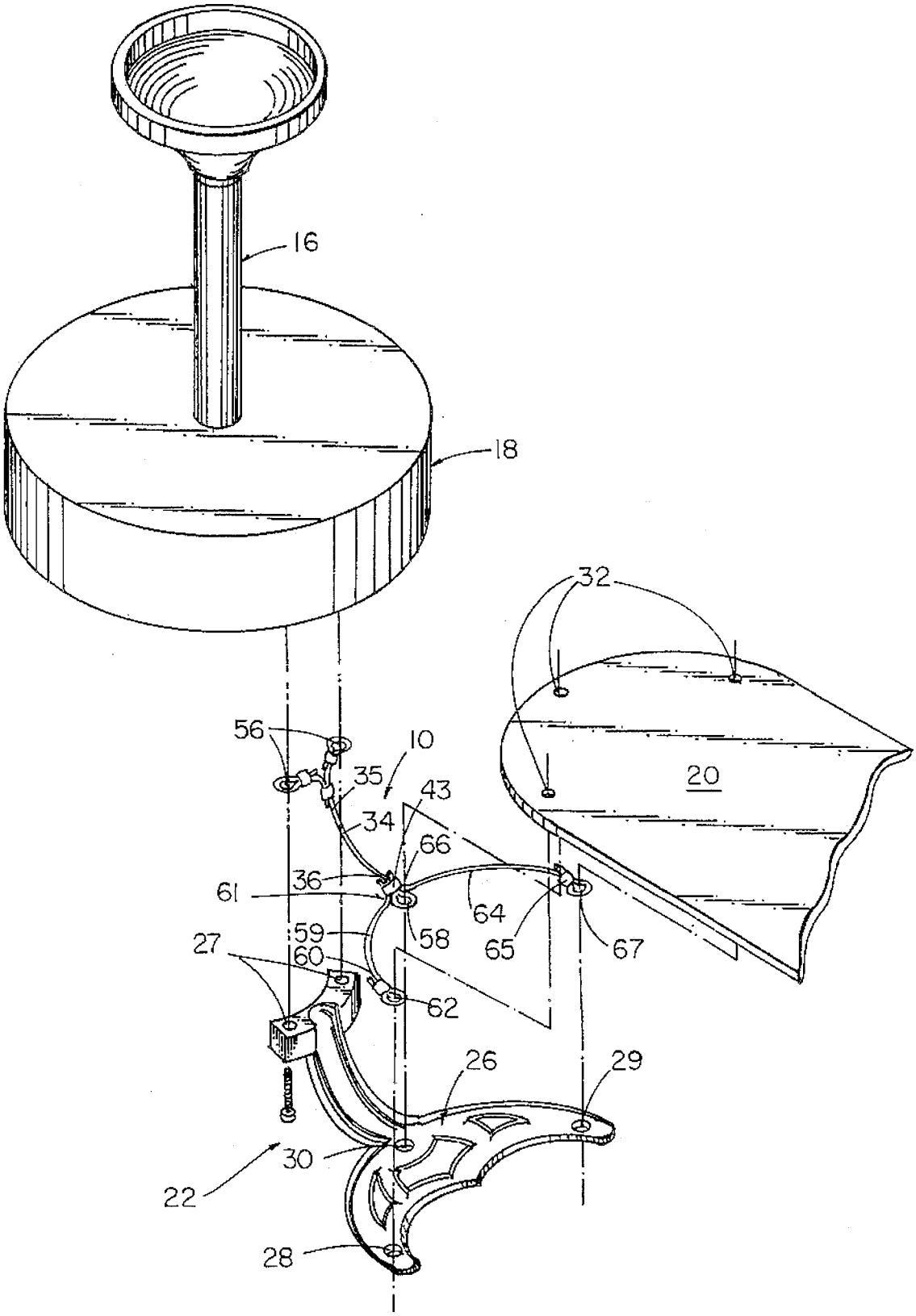
FIG. 7 is an isometric assembly view illustrating an alternate first and second anchoring means, having multiple securing and anchoring eyelets, the alternate embodiment of the ceiling fan safety tether being shown in relative position to the fan blade bracket, the fan blade, and the fan motor housing.

In referring to FIG. 7, a third embodiment of the ceiling fan safety tether 10 is illustrated. The body portion 34 of the ceiling fan safety tether 10 has an alternate first and second anchoring means coupled thereto. The first anchoring means includes a pair of anchoring eyelets 56 formed in a similar manner as in the first embodiment of FIGS. 2 and 2*a*. The pair of anchoring eyelets 56 are aligned with the mounting holes 27 of the mounting portion 24 and interposed between the mounting portion 24 and the fan motor housing 18. Conventional screws, or the like, are inserted through the mounting holes 27 of the mounting portion 24, through the pair of anchoring eyelets 56 and into threaded engagement with the fan motor housing 18.

The second anchoring means includes a central anchoring eyelet 58 formed in a similar manner as previously described and illustrated in the first embodiment of FIGS. 2 and 2*a*. A first lateral arm 59 having one distal end 60 and a first proximal end 61 is secured to the central anchoring eyelet 58 by way of the first proximal end 61 being securely crimped thereto by the second crimp collar 43. The central anchoring eyelet 58 is analogous to and formed in a similar manner as the first securing eyelet 40 of the first embodiment previously described and illustrated in FIGS. 2 and 2*a*. The one distal end 60 of the first lateral arm 59 has a first anchoring eyelet 62 secured thereto. The first anchoring eyelet 62 being formed in a similar manner as the first securing eyelet 40 of the first embodiment previously described and illustrated in FIGS. 2 and 2*a*.

A second lateral arm 64 having a second distal end 65 and a second proximal end 66 is secured to the central anchoring eyelet 58 by way of the second proximal end 66 being securely crimped thereto by the second crimp collar 43. The second distal end 65 of the second lateral arm 64 has a second anchoring eyelet 67 secured thereto. The second anchoring eyelet 67 is formed in a similar manner as the first securing eyelet 40 of the first embodiment described previously and illustrated in FIGS. 2 and 2*a*. The central anchoring eyelet 58, the first anchoring eyelet 62, and the second anchoring eyelet 67 are then placed in alignment with the middle screw hole 30, the first screw hole 28, and the second screw hole 29, respectively, of the blade support portion 26. The central, first, and second anchoring eyelets, 58, 62 and 67 respectively, are interposed between the blade support portion 26 of the fan blade bracket 22 and the fan blade 20. Conventional screws, or the like, are then inserted through the middle, first, and second screw holes, 30, 28 and 29 respectively, through the central, first, and second anchoring eyelets, 58, 62 and 67 respectively, aligned therewith, and into threaded engagement with corresponding securing holes 32 of the fan blade 20.

Figure 8:
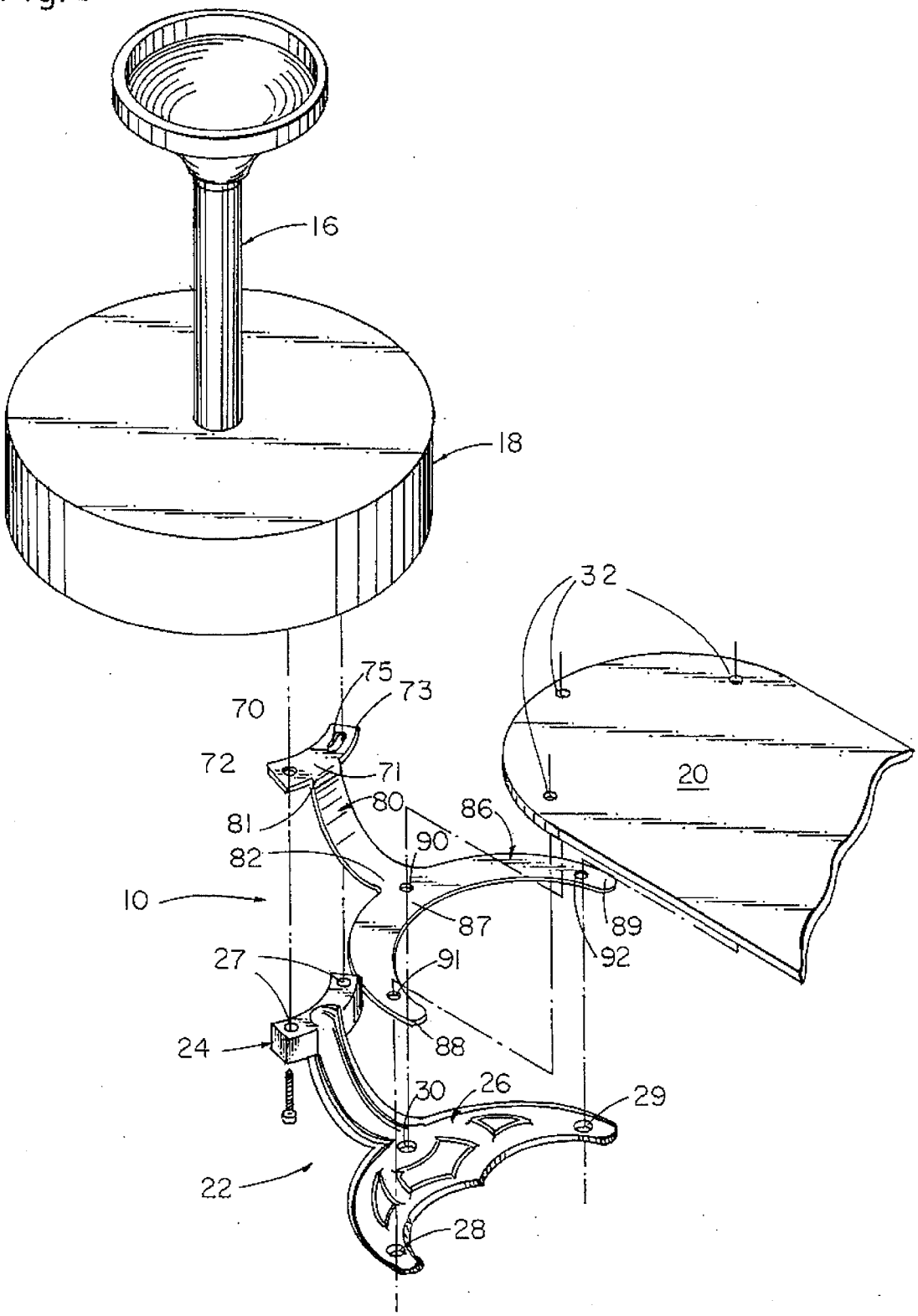
FIG. 8 is an isometric assembly view of another alternate embodiment of the ceiling fan safety tether formed generally from a single integral piece of flat, strap-like material in relative position to the fan blade bracket, the fan blade, and the fan motor housing.

Finally, in referring to FIG. 8, a fourth embodiment of the ceiling fan safety tether 10 is illustrated. This particular embodiment is a single one-piece unit made from a flexible flat strap-like material. The ceiling fan safety tether 10, as illustrated in FIG. 8, is punch-formed from a sheet of nylon material. This embodiment of the ceiling fan safety tether 10 includes a small arcuate member 70 having a first midportion 71, one end 72, and an opposite end 73. A first hole 74 is positioned near the one end 72 and a second hole 75 is positioned near the opposite end 73 of the small arcuate member 70. An extension member 80 having a first end 81 and a second end 82 is integrally coupled at its first end 81 to the first midportion 71 of the small arcuate member 70. A large arcuate member 86 having a second midportion 87, a first distal end 88, and a second distal end 89 is integrally coupled at its second midportion 87 to the second end 82 of the extension member 80. A central hole 90 is positioned in the second midportion 87. A first distal hole 91 is positioned near the first distal end 88 and a second distal hole 92 is positioned near the second distal end 89 of the large arcuate member 86.

In securing the strap-like ceiling fan safety tether 10 as illustrated in FIG. 8, the small arcuate member 70 is interposed between the mounting portion 24 of the fan blade bracket 22 and the fan motor housing 18, the first and second holes, 74 and 75, of the small arcuate member 70 are placed in alignment with the mounting holes 27 in the mounting portion 24 of the fan blade bracket 22. Conventional screws, or the like, are then inserted through the mounting holes 27, through the aligned first and second holes, 74 and 75, of the small arcuate member 70 and threadedly into the fan motor housing 18. The extension member 80, being conformal with the shape of the fan blade bracket 22, integrally extends to the large arcuate member 86. The large arcuate member 86 is then interposed between the blade support portion 26 of the fan blade bracket 22 and the fan blade 20. The central, first distal and second distal holes, 90, 91 and 92, respectively, of the large arcuate member 86 are placed in alignment with the middle, first and second screw holes, 30, 28 and 29, respectively, of the blade support portion 26 and also in alignment with corresponding securing holes 32 of the fan blade 20. Conventional screws, or the like, are then inserted therethrough to threadingly engage the securing holes 32 of the fan blade 20 thereby securing the ceiling fan safety tether 10 to the fan blade 20.

The alternate embodiment of the ceiling fan safety tether 10 formed from the flat flexible strap-like material, as illustrated in FIG. 8, serves to also dampen the vibrations being created in the fan motor housing 18 and transmitted to the fan blade 20. The dampening objective is in addition to the objective of providing a ceiling fan safety tether 10 for retaining the fan blade 20 in close proximity to the fan motor housing 18 in the unlikely event of a break in the fan blade bracket 22. This dampening effect serves to provide a quieter, more efficient, and safer ceiling fan. The decrease in the vibration of the fan blade 20 thereby decreases the tendency of the fan blade 20 to become loose over long-term use.

The present disclosure includes that contained in the appended claims as well as that of the foregoing description. Although this invention has been described in its preferred form with a certain degree of particularity, it should be understood that the present disclosure of the preferred embodiment has been made only by way of example and that numerous changes in the details of construction and combination and arrangement of parts may be resorted to without departing from the spirit and scope of the invention.

Now that the invention has been described,

What is claimed is:

1. A ceiling fan safety tether for a ceiling fan having a fan motor housing, a fan blade bracket coupled to the fan motor housing, and a fan blade coupled to said fan blade bracket, the ceiling fan safety tether comprising in combination:

a body portion having a first end and a second end, said body portion being of flexible material and, elongated in shape;

a first anchoring means for anchoring said first end of said body portion to the fan motor housing, said first anchoring means being coupled to said first end of said body portion; and a second anchoring means for anchoring said second end of said body portion to the fan blade, said second anchoring means being coupled to said second end of said body portion.

said first anchoring means including a spherical bead coupled to said first end of said body portion, and the fan blade bracket including a mounting portion having a groove positioned thereon, said groove being smaller in dimension than said spherical bead, whereby said groove receives said first end of said body portion and said spherical bead forcibly engages said groove when said mounting portion is coupled to said fan motor housing, whereby the fan blade is retained in close proximity to fan motor housing in the event a break in the fan blade bracket occurs thereby preventing the fan blade from becoming a flying projectile.

2. A ceiling fan safety tether for a ceiling fan having a fan motor housing, a fan blade bracket coupled to the fan motor housing, and a fan blade coupled to said fan blade bracket, the ceiling fan safety tether comprising in combination:

a body portion having a first end and a second end, said body portion being of a flexible material and, elongated in shape;

a first anchoring means for anchoring said first end of said body portion to the fan motor housing, said first anchoring means being coupled to said first end of said body portion; and a second anchoring means for anchoring said second end of said body portion to the fan blade, said second anchoring means being coupled to said second end of said body portion, said second anchoring means further comprising:

a central anchoring eyelet;

a first lateral arm coupled to said central anchoring eyelet, said first lateral arm having one distal end and a first anchoring eyelet coupled thereto;

a second lateral arm coupled to said central anchoring eyelet, said second lateral arm having a second distal end with a second anchoring eyelet coupled thereto;

whereby said central, first and second anchoring eyelets are each coupled to the fan blade so as to retain the fan blade in close proximity to the fan motor housing should a break in the fan blade bracket ever occur thereby preventing the fan blade from becoming a flying projectile.

3. The ceiling fan safety tether as recited in claim 2, wherein said first anchoring means comprises a pair of anchoring eyelets coupled to said first end of said body portion.

4. A ceiling fan safety tether for a ceiling fan having a fan motor housing, a fan blade bracket coupled to the fan motor housing, and a fan blade coupled to the fan blade bracket, the ceiling fan safety tether comprising in combination:

an extension member having a first end and a second end;

a small arcuate member having a first mid-portion, one end, and an opposite end, said first end of said extension member being coupled to said first mid-portion of said small arcuate member, said one end of said small arcuate member having a first hole therein, said opposite end of said small arcuate member having a second hole therein; and a large arcuate member having a second mid-portion, a first distal end, and a second distal end, said large arcuate member being coupled at said second mid-portion to said second end of said extension member, said second mid-portion of said large arcuate member having a central hole, and said first and second distal ends having a first distal hole and a second distal hole, respectively, whereby said small arcuate member is coupled to said fan motor housing via said first and second holes and said large arcuate member is coupled to said fan blade via said central hole, said first distal hole, and said second distal hole to thereby retain said fan blade in close proximity to said fan motor housing should a break in said fan blade bracket ever occur thereby preventing said fan blade from becoming a flying projectile.

5. The ceiling fan safety tether as recited in claim 4, wherein said small arcuate member is integrally coupled to said first end of said extension member, and said large arcuate member is integrally coupled to said second end of said extension member, whereby said ceiling fan safety tether is an integral one-piece unit.

6. The ceiling fan safety tether as recited in claim 5, wherein said small arcuate member, said extension member, and said large arcuate member are constructed generally from a flexible flat strap-like material.

7. A ceiling fan assembly comprising in combination:

a fan motor housing;

a fan blade bracket having a mounting portion and a blade support portion, said mounting portion being coupled to said fan motor housing;

a fan blade coupled to said blade support portion of said fan blade bracket; and a ceiling fan safety tether, wherein said ceiling fan safety tether further comprises a body portion having a first end and a second end, said body portion being of a flexible material and elongated in shape, a first anchoring means for anchoring said first end of said body portion to said fan motor housing, said first anchoring means being coupled to said first end of said body portion, and a second anchoring means for anchoring said second end of said body portion to said fan blade, said second anchoring means being coupled to said second end of said body portion, whereby said fan blade is retained in close proximity to said fan motor housing should a break in said fan blade bracket ever occur thereby preventing said fan blade from becoming a flying projectile.

8. The ceiling fan assembly as recited in claim 7, wherein said first anchoring means includes a spherical bead coupled to said first end of said body portion, and said mounting portion of said fan blade bracket includes a groove positioned thereon, said groove being smaller in dimension than said spherical bead, whereby said groove receives said first end of said body portion and said spherical bead coupled to said first end forcibly engages said groove when said mounting portion is coupled to said fan motor housing.

9. The ceiling fan assembly as recited in claim 7, wherein said second anchoring means further comprises:

a central anchoring eyelet;

a first lateral arm coupled to said central anchoring eyelet, said first lateral arm having one distal end and a first anchoring eyelet coupled thereto;

a second lateral arm coupled to said central anchoring eyelet, said second lateral arm having a second distal end with a second anchoring eyelet coupled thereto;

whereby said central, first and second anchoring eyelets are each coupled to said fan blade so as to retain said fan blade should a break in said fan blade bracket ever occur.

10. The ceiling fan assembly as recited in claim 9, wherein said first anchoring means comprises a pair of anchoring eyelets coupled to said first end of said body portion.

* * * * *